US008633876B2

(12) United States Patent
Lee et al.

(10) Patent No.: US 8,633,876 B2
(45) Date of Patent: Jan. 21, 2014

(54) PIXEL AND ORGANIC LIGHT EMITTING DISPLAY USING THE SAME

(75) Inventors: An-Su Lee, Yongin (KR); Yang-Wan Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 949 days.

(21) Appl. No.: 12/379,888

(22) Filed: Mar. 4, 2009

(65) Prior Publication Data

US 2009/0225013 A1 Sep. 10, 2009

(30) Foreign Application Priority Data

Mar. 4, 2008 (KR) ..... 10-2008-0020022

(51) Int. Cl.
*G09G 3/30* (2006.01)

(52) U.S. Cl.
USPC ..... 345/78; 345/76; 345/77

(58) Field of Classification Search
USPC ..... 345/76–83, 204–215, 690–699; 315/169.1–169.4
See application file for complete search history.

(56) References Cited

U.S. PATENT DOCUMENTS

| | | | | |
|---|---|---|---|---|
| 6,864,637 | B2 | 3/2005 | Park et al. | |
| 6,873,116 | B2 * | 3/2005 | Kimura et al. | 315/169.1 |
| 6,958,750 | B2 | 10/2005 | Azami et al. | |
| 7,365,742 | B2 | 4/2008 | Kim et al. | |
| 8,054,258 | B2 * | 11/2011 | Choi et al. | 345/82 |
| 8,111,218 | B2 * | 2/2012 | Choi | 345/76 |
| 8,111,219 | B2 * | 2/2012 | Kim | 345/76 |
| 2005/0140600 | A1 | 6/2005 | Kim et al. | |
| 2005/0200575 | A1 * | 9/2005 | Kim et al. | 345/76 |
| 2005/0269958 | A1 | 12/2005 | Choi et al. | |
| 2006/0103324 | A1 | 5/2006 | Kim et al. | |
| 2006/0253755 | A1 * | 11/2006 | Wu | 714/726 |
| 2007/0040772 | A1 * | 2/2007 | Kim | 345/76 |
| 2007/0085780 | A1 * | 4/2007 | Peng et al. | 345/76 |
| 2008/0036710 | A1 * | 2/2008 | Kim | 345/82 |
| 2008/0111804 | A1 * | 5/2008 | Choi et al. | 345/205 |
| 2008/0224965 | A1 * | 9/2008 | Kim | 345/76 |
| 2008/0309653 | A1 * | 12/2008 | Takahashi et al. | 345/211 |
| 2009/0146987 | A1 * | 6/2009 | Kim et al. | 345/212 |
| 2009/0167648 | A1 * | 7/2009 | Jeon et al. | 345/76 |
| 2010/0201656 | A1 * | 8/2010 | Han et al. | 345/205 |

(Continued)

FOREIGN PATENT DOCUMENTS

| | | | |
|---|---|---|---|
| JP | 2003-029707 | A | 1/2003 |
| JP | 2005-189696 | A | 7/2005 |
| KR | 10-2004-0005163 | A | 1/2004 |
| KR | 10-2005-0051300 | A | 6/2005 |

(Continued)

*Primary Examiner* — Alexander Eisen
*Assistant Examiner* — Patrick F Marinelli
(74) *Attorney, Agent, or Firm* — Lee & Morse, P.C.

(57) ABSTRACT

A pixel includes an OLED, a first transistor coupled to a data line and a scan line, a second transistor coupled to the OLED and being configured to supply current to the OLED, a third transistor coupled to a gate electrode and a second electrode of the second transistor, a fourth transistor coupled to a first reference power supply and a light emitting control line, a fifth transistor coupled to the driving transistor and the OLED, a first capacitor coupled between the gate electrode of the driving transistor and a first power supply, a second capacitor coupled between the gate electrode of the driving transistor and the first node, and a compensator configured to control a voltage of the gate electrode of the driving transistor with respect to deterioration of the OLED.

14 Claims, 3 Drawing Sheets

(56) References Cited

U.S. PATENT DOCUMENTS

| | | | | |
|---|---|---|---|---|
| 2011/0193850 | A1* | 8/2011 | Chung et al. | 345/212 |
| 2011/0199357 | A1* | 8/2011 | Chung et al. | 345/211 |
| 2012/0026146 | A1* | 2/2012 | Kim | 345/211 |

FOREIGN PATENT DOCUMENTS

| | | | |
|---|---|---|---|
| KR | 10-2005-0098485 | A | 10/2005 |
| KR | 10-2006-0054603 | A | 5/2006 |
| KR | 10-0623919 | B1 | 9/2006 |

* cited by examiner

PIXEL AND ORGANIC LIGHT EMITTING DISPLAY USING THE SAME

BACKGROUND

1. Field of the Invention

Example embodiments relate to a pixel and an organic light emitting display using the same. More particularly, example embodiments relate to a pixel and an organic light emitting display capable of compensating for deterioration of an organic light emitting diode.

2. Description of the Related Art

Flat panel display devices may have reduced weight and volume, as compared, e.g., to a cathode ray tube (CRT) display device. Examples of flat panel display devices may include a liquid crystal display (LCD) device, a field emission display (FED) device, a plasma display panel (PDP) apparatus, an organic light emitting display device, etc.

For example, the organic light emitting display device may display an image using an organic light emitting diode (OLED) generating light by recombination of electrons and holes. Such an organic light emitting display device may exhibit rapid response speed and low power consumption. A conventional organic light emitting display device may include a plurality of pixels, and each pixel may include an OLED.

FIG. 1 illustrates a circuit view of a pixel of a conventional organic light emitting display. Referring to FIG. 1, a pixel 4 of the conventional organic light emitting display may include an OLED and a pixel circuit 2 coupled with a data line Dm and a scan line Sn to control the OLED. The pixel circuit 2 may include a first transistor M1, a second transistor M2, and a storage capacitor Cst to facilitate control of the OLED.

However, when the OLED of the conventional organic light emitting display device deteriorates, images displayed by the conventional organic light emitting display may exhibit reduced brightness. In other words, the OLED of the conventional organic light emitting display device may deteriorate over time, so that an image having a desired brightness cannot be displayed.

SUMMARY

Example embodiments are therefore directed to a pixel and an organic light emitting display, which substantially overcome one or more of the shortcomings and disadvantages of the related art.

It is therefore a feature of an example embodiment to provide a pixel capable of compensating for deterioration of an OLED.

It is another feature of an example embodiment to provide an organic light emitting display with a pixel capable of compensating for deterioration of an OLED.

At least one of the above and other features may be realized by providing a pixel, including an OLED, a driving transistor that supplies current to the OLED, a first transistor of which a first electrode is coupled to a data line, a second electrode is coupled to a first node, and a gate electrode is coupled to a scan line; a fourth transistor coupled between a first reference power supply and the first node and of which a gate electrode is coupled to any one of an i-th (i is a natural number) light emitting control line and an (i−1)-th light emitting control line; a second capacitor coupled between a gate electrode of the driving transistor and the first node; a first capacitor coupled between the gate electrode of the driving transistor and a first power supply, a third transistor coupled between the gate electrode and the second electrode of the driving transistor and of which a gate electrode is coupled to the scan line, a fifth transistor coupled between the driving transistor and the OLED and of which a gate electrode is coupled to the i-th light emitting control line, and a compensator that controls voltage of the gate electrode of the driving transistor in accordance with deterioration of the OLED.

At least one of the above and other features may be also realized by providing an organic light emitting display, including a scan driver that sequentially supplies scan signals to scan lines and sequentially supplies light emitting control signals to control lines, a data driver that supplies data signals to data lines; and pixels positioned at intersection parts of the scan lines, light emitting control lines and data lines, wherein the respective pixels includes an OLED, a driving transistor that supplies current to the OLED, a first transistor having a first electrode coupled to a data line and a second electrode coupled to a first node, and turned on when the scan signal is supplied to the scan line, a fourth transistor coupled between a first reference power supply and the first node and turned off when the light emitting signal is supplied to an i-th (i is a natural number) light emitting control line and an (i−1)-th light emitting control line; a second capacitor coupled between a gate electrode of the driving transistor and the first node; a first capacitor coupled between the gate electrode of the driving transistor and a first power supply, a third transistor coupled between the gate electrode and the second electrode of the driving transistor and turned on when the scan signal is supplied to the scan line, a fifth transistor coupled between the driving transistor and the OLED and turned off when the light emitting control signal is supplied to the i-th light emitting control line, and a compensator that controls voltage of the gate electrode of the driving transistor with respect to deterioration of the OLED.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION

Figure 1:
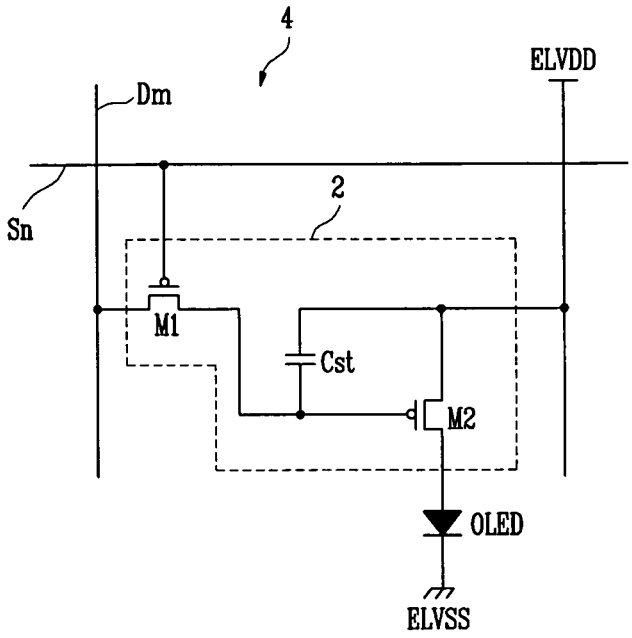
FIG. 1 illustrates a circuit diagram of a pixel in a conventional organic light emitting display.

Korean Patent Application No. 10-2008-0020022, filed on Mar. 4, 2008, in the Korean Intellectual Property Office, and entitled: "Pixel and Organic Light Emitting Display Using the Same," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers, elements, and/or regions may be exaggerated for clarity of illustration. It will also be understood that when a layer or element is referred to as being "between" two layers or elements, it can be the only layer or element between the two layers or elements, or one or more intervening layers or elements may also be present. Further, it will also be understood that when a layer or element is referred to as being "coupled" to another layer or elements, the two layers or elements may be coupled directly to each other, or one or more intervening layers or elements may also be present. Further, some elements that are not essential to a complete understanding of the example embodiments may be omitted for clarity. Like reference numerals refer to like elements throughout.

As used herein, the terms "a" and "an" are open terms that may be used in conjunction with singular items or with plural items.

Figure 2:
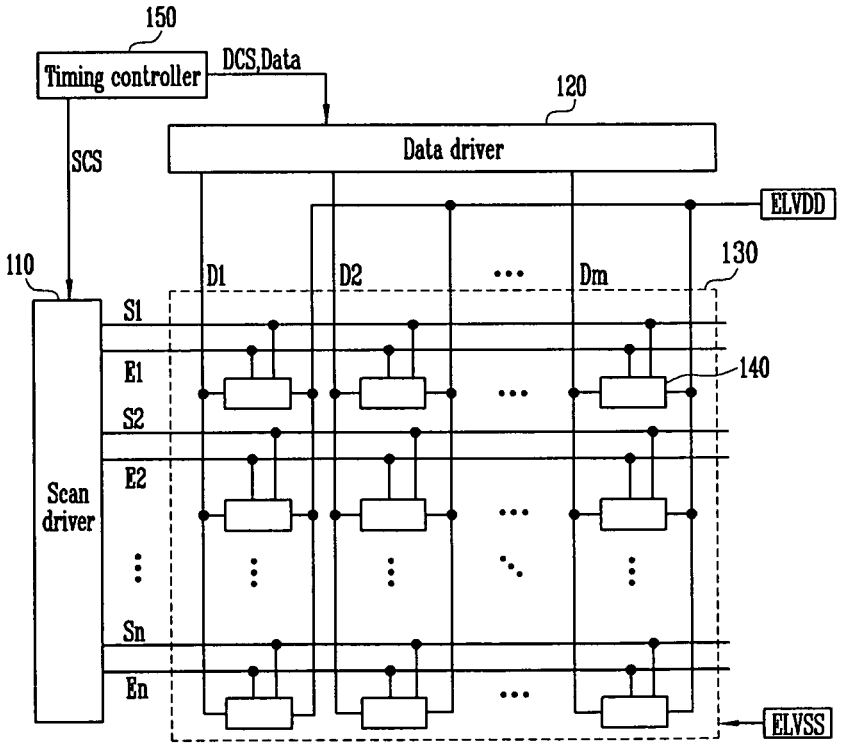
FIG. 2 illustrates a schematic diagram of an organic light emitting display according to an example embodiment.

Hereinafter, an example embodiment of an organic light emitting display will be described with reference to FIGS. 2-4. FIG. 2 illustrates an organic light emitting display according to an example embodiment. Referring to FIG. 2, the organic light emitting display may include a pixel unit 130, a scan driver 110, a data driver 120, and a timing controller 150.

As illustrated in FIG. 2, the pixel unit 130 may include a plurality of pixels 140 formed at intersection regions of scan lines S1 to Sn, light emitting control lines E1 to En, and data lines D1 to Dm. For example, each pixel 140 may be coupled to a corresponding scan line, data line, and light emitting control line. The pixels 140 may be supplied with first power ELVDD and second power ELVSS from external power sources. Each pixel 140 may include an OLED, so the pixel 140 may control an amount of current supplied to the second power supply ELVSS from the first power supply ELVDD via the OLED with respect to a data signal from the data line. The OLED may generate light having a predetermined brightness.

The pixels 140 may include driving transistors that supply current to the respective OLEDs. In example embodiments, voltage of a gate electrode of the driving transistors may be controlled to compensate for deterioration of the OLED, as will be described in more detail below with reference to FIGS. 3-4.

The timing controller 150 of the organic light emitting display may control the scan driver 110 and the data driver 120 by corresponding to synchronization signals supplied from an external source. The timing controller 150 may generate a data driver control signal DCS and a scan driver control signal SCS in accordance with the synchronization signals. As illustrated in FIG. 2, the data driver control signal DCS generated by the timing controller 150 may be supplied to the data driver 120, and the scan driver control signal SCS generated by the timing controller 150 may be supplied to the scan driver 110. The timing controller 150 may further supply Data signal, i.e., data supplied from the external source, to the data driver 120.

The scan driver 110 may drive the scan lines S1 to Sn and the light emitting control lines E1 to En. The scan driver 110 may receive the scan driver control signal SCS from the timing controller 150, and may sequentially supply scan signals, e.g., low voltage signals, to the scan lines S1 to Sn in response to the scan driver control signal SCS. Further, the scan driver 110 may sequentially supply light emitting control signal, e.g., high voltage signals, to the light emitting control lines E1 to En in response to the scan driver control signal SCS. For example, a light emitting control signal may be supplied to an i-th light emitting control line Ei (i is a natural number) after a scan signal is supplied to the i-th scan line Si. Then, the supply of the light emitting control signal to the i-th light emitting control line Ei may be suspended after supply of the scan signal to the i-th scan line Si is suspended.

The data driver 120 may drive the data lines D1 to Dm. The data driver 120 may receive the data driver control signal DCS and the data Data from the timing controller 150. The data driver 120 may generate data signals in response to the data driver control signal DCS and the data Data, and may supply the generated data signals to the data lines D1 to Dn.

Figure 3:
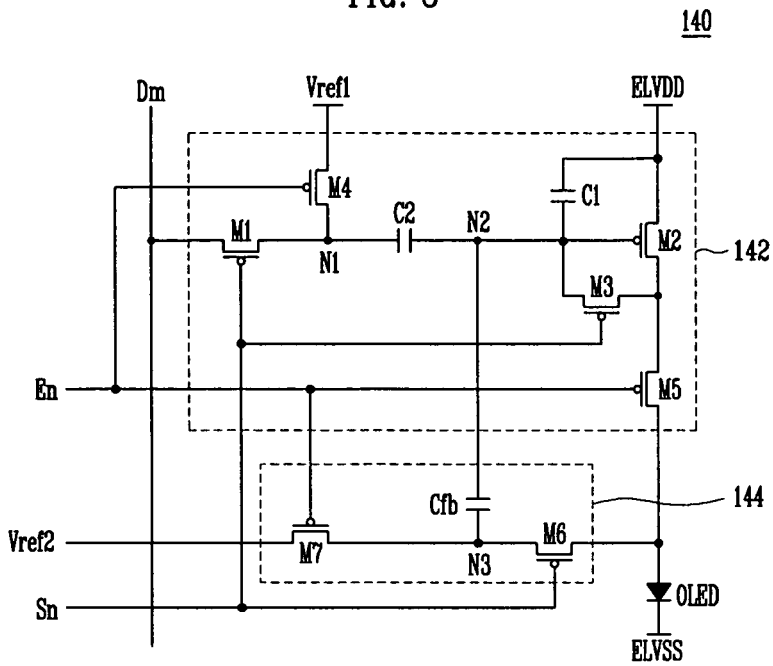
FIG. 3 illustrates a circuit diagram of a pixel according to an example embodiment.

FIG. 3 illustrates a circuit view of a pixel according to an example embodiment. For convenience of explanation, a pixel 140 coupled to an n scan line Sn and an m data line Dm is illustrated in FIG. 3.

Referring to FIG. 3, the pixel 140 may include an OLED, a pixel circuit 142 that controls an amount of current supplied to the OLED, and a compensator 144 that compensates for deterioration of the OLED. An anode electrode of the OLED may be coupled to the pixel circuit 142, and a cathode electrode of the OLED may be coupled to a second power supply ELVSS. Such an OLED may generate light having a predetermined brightness in accordance with an amount of current supplied from a second transistor M2 (that is, a driving transistor) via a fifth transistor M5, as will be discussed in more detail below.

The pixel circuit 142 of the pixel 140 may control the amount of current supplied to the OLED. As illustrated in FIG. 3 the pixel circuit 142 may include five transistors M1 to M5, a first capacitor C1, and a second capacitor C2.

A gate electrode of the first transistor M1 may be coupled to the scan line Sn, a first electrode of the first transistor M1 may be coupled to a data line Dm, and a second electrode of the first transistor M1 may be coupled to a first node N1. The first transistor M1 may be turned on when a scan signal is supplied to the scan line Sn, so a data signal may be supplied from the data line Dm to the first node N1 through the first transistor M1. It is noted that first and second electrodes of transistors refer to source and drain electrodes.

A gate electrode of the second transistor M2 may be coupled to a second node N2, a first electrode of the second transistor M2 may be coupled to a first power supply ELVDD, and a second electrode of the second transistor M2 may be coupled to a first electrode of the fifth transistor M5. The second transistor M2 may control an amount of current flowing from the first power supply ELVDD to a second power supply ELVSS via the OLED with respect to a voltage at the second node N2. The first power ELVDD may be set as a higher voltage value than the second power ELVSS. The second transistor M2 may be referred to as a driving transistor.

A gate electrode of the third transistor M3 may be coupled to the scan line Sn, a first electrode of the third transistor M3 may be coupled to the second electrode of the second transistor M2, and a second electrode of the third transistor M3 may be couple to the second node N2. The third transistor M3 is turned on when the scan signal is supplied to the scan line Sn, so the second transistor M2 may be coupled in a diode shape, i.e., the second transistor M2 may operate as a diode.

A gate electrode of the fourth transistor M4 may be coupled to a light emitting control line En, a first electrode of the fourth transistor M4 may be coupled to a first reference power supply Vref1, and a second electrode of the fourth transistor M4 may be coupled to the first node N1. The fourth transistor M4 may be turned off when a light emitting control signal is supplied to the light emitting control line En, and may be turned on when supply of the light emitting control signal is suspended. When the fourth transistor M4 is turned on, voltage of the first reference power supply Vref1 is supplied to the first node N1. The first reference power supply Vref1 may be set as a higher voltage value than the data signal. For example, the first reference power Vref1 may be set as the same voltage value as the first power ELVDD.

A gate electrode of the fifth transistor M5 may be coupled to the light emitting control line En, a first electrode of the fifth transistor M5 may be coupled to the second electrode of the second transistor M2, and a second electrode of the fifth transistor M5 may be coupled to the anode electrode of the organic light emitting diode OLED. The fifth transistor M5 may be turned off when a light emitting control signal is supplied to the light emitting control line En, and may be turned on when supply of the light emitting control signal is suspended.

The first capacitor C1 may be positioned between the second node N2 and the first power supply ELVDD. The first capacitor C1 is charged with voltage corresponding to a threshold voltage of the second transistor M2.

The second capacitor C2 may be positioned between the first node N1 and the second node N2. The second capacitor C2 is charged with voltage corresponding to the threshold voltage of the second transistor M2 and the data signal.

The compensator 144 of the pixel 140 may control a voltage of the gate electrode of the second transistor M2, i.e., a voltage at the second node N2, in accordance with deterioration of the OLED. In other words, the compensator 144 may control the voltage at the second node N2 to compensate for the deterioration of the OLED. As illustrated in FIG. 3, the compensator 144 may include a sixth transistor M6, a seventh transistor M7, and a feedback capacitor Cfb.

A gate electrode of the sixth transistor M6 may be coupled to the scan line Sn, a first electrode of the sixth transistor M6 may be coupled to a third node N3, and a second electrode of the sixth transistor M6 may be coupled to the anode electrode of the OLED. The sixth transistor M6 is turned on when the scan signal is supplied to the scan line Sn, so voltage at the third node N3 may equal to a threshold voltage of the OLED.

A gate electrode of the seventh transistor M7 may be coupled to the light emitting control line En, a first electrode of the seventh transistor M7 may be coupled to a second reference power supply Vref2, and a second electrode of the seventh transistor M7 may be coupled to the third node N3. The seventh transistor M7 is turned off when the light emitting control signal is supplied to the light emitting control line En, and is turned on when the light emitting control signal is suspended. When the seventh transistor M7 is turned on, the voltage of the second reference power supply Vref2 may be supplied to the third node N3.

The voltage of the second reference power supply Vref2 may be higher or lower voltage than the threshold voltage of the OLED. For example, when the voltage of the second reference power supply Vref2 is higher than the threshold voltage of the OLED, the voltage of the second reference power supply Vref2 may substantially equal the voltage of the first reference power supply Vref1. In another example, when the voltage of the second reference power supply Vref2 is lower than the threshold voltage of the OLED, the voltage of the second reference power supply Vref2 may substantially equal the voltage of the second power ELVSS.

The feedback capacitor Cfb may be positioned between the second node N2 and the third node N3. The feedback capacitor Cfb may transfer voltage variations of the third node N3 to the second node N2.

Figure 4:
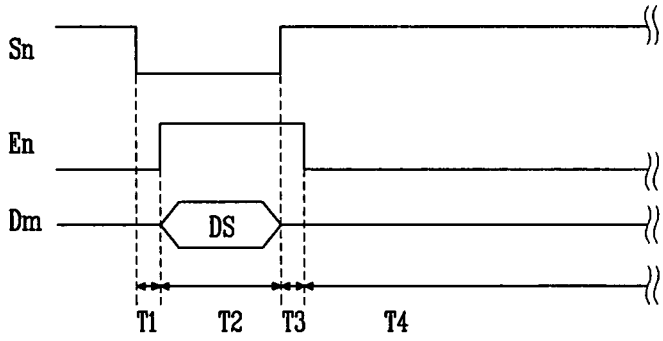
FIG. 4 illustrates a driving method of the pixel of FIG. 3.

FIG. 4 illustrates a driving method of the pixel of FIG. 3. An example operation process, i.e., driving of a pixel 140, will be explained in detail below with reference to FIGS. 3-4.

First, a scan signal may be supplied to a scan line Sn at a beginning of a first period T1, as illustrated in FIG. 4. Accordingly, the first transistor M1, third transistor M3, and sixth transistor M6 are turned on. When the third transistor M3 is turned on, the second node N2 is electrically coupled to the second power supply ELVSS via the fifth transistor M5 and the OLED. Accordingly, at the beginning of the first period T1, voltage at the second node N2 may be initialized to substantially equal voltage of the second power supply ELVSS.

Next, while the scan signal is still being supplied to the scan line Sn, a light emitting control signal may be supplied to the light emitting control line En at a beginning of a second period T2, as illustrated in FIG. 4. Accordingly, the fourth transistor M4, fifth transistor M5, and seventh transistor M7 are turned off. When the fifth transistor M5 is turned off, the electrical coupling between the second transistor M2 and the OLED may be blocked. At this time, since the third transistor M3 maintains a turn-on state, the second transistor M2 may be diode-connected. Accordingly, during the second period T2, a voltage value at the second node N2 may equal a difference between the first power ELVDD and the threshold voltage of the second transistor M2. Further, the first capacitor C1 may be charged with a voltage value corresponding to the threshold voltage of the second transistor M2.

The data signal DS may be supplied through the data line Dm and the first transistor M1 to the first node N1 during the second period T2. Therefore, the second capacitor C2 may be charged with voltage corresponding to the data signal DS. Since the sixth transistor M6 maintains a turn-on state while the data signal is supplied to the first node N1, the voltage of the third node N3 may be set as the threshold voltage of the OLED.

The supply of the scan signal to the scan line Sn may be suspended at a beginning of a third period T3. Accordingly, the first transistor M1, the third transistor M3, and the sixth transistor M6 are turned off.

The supply of the light emitting control signal to the light emitting control line En may be suspended at a beginning of a fourth period T4. Accordingly, the fourth transistor M4, the fifth transistor M5, and the seventh transistor M7 are turned on.

When the fourth transistor M4 is turned on, the voltage of the first node N1 may rise from the voltage of the data signal DS to the voltage of the first reference power supply Vref1. In this case, the voltage of the second node N2 that is set at a floating state may vary to correspond to a voltage rising amount of the first node N1.

When the seventh transistor M7 is turned on, the voltage of the third node N3 may change from the threshold voltage of the OLED into the voltage of the second reference power supply Vref2. If the voltage of the second reference power supply Vref2 is set as a higher voltage than the threshold voltage of the OLED, the voltage of the third node N3 may rise from the threshold voltage of the OLED to the voltage of the second reference power supply Vref2. If the voltage of the third node N3 rises, the voltage of the second node N2 may also rise by the feedback capacitor Cfb. In other words, the voltage of the second node N2 may vary according to voltage variations of the third node N3.

When the fifth transistor M5 is turned on, the second transistor M2 may facilitate current flow from the first power supply ELVDD to the second power supply ELVSS via the OLED in accordance with the voltage at the gate electrode of the second transistor M2, i.e., electric current corresponding to the voltage at the second node N2. Therefore, the OLED may generate light having predetermined brightness corresponding to the amount of current supplied from the second transistor M2.

If the OLED deteriorates over time, the threshold voltage of the OLED may increase. Therefore, as a deterioration degree of the OLED increases, voltage variation, i.e., increase, at the third node N3 decreases. In other words, as a deterioration degree of the OLED increases, the threshold voltage of the OLED supplied to the third node N3 increases. Therefore, a voltage difference between the threshold voltage of the OLED and the second reference power supply Vref2, i.e., a degree of voltage increase at the third node N3, decreases. Accordingly, the degree of voltage increase at the third node N3 is lower when the OLED is deteriorated.

If the degree of voltage increase at the third node N3 is set to be low, a degree of voltage increase at the second node N2 is also lowered. Therefore, an amount of current supplied to the OLED from the second transistor M2 for the same data signal increases. In other words, according to example embodiments, an increase in OLED deterioration may cause an increased current supply from the second transistor M2 to the OLED, thereby compensating for a brightness drop due to the OLED deterioration.

Alternatively, if the second reference power Vref2 is lower than the threshold voltage of the OLED, the voltage of the third node N3 falls when the seventh transistor M7 is turned on. Accordingly, deterioration of the OLED may increase the degree of voltage increase at the third node N3. In other words, the more the OLED deteriorates, the more the voltage of the OLED supplied to the third node N3 increases. Therefore, the voltage variation at the third node N3 when the OLED is deteriorated, i.e., a difference between the second reference power Vref2 and the threshold voltage of the OLED at the third node N3, is larger than that when the OLED is not deteriorated.

If the voltage variation at the third node N3 is set to be large, the voltage variation at the second node N2 is also large. Therefore, the amount of current supplied to the OLED from the second transistor M2 by corresponding to the same data signal increases. In other words, according to example embodiments, increased deterioration of the OLED increases current supply to the OLED from the second transistor M2, and accordingly, the brightness drop due to the deterioration of the OLED may be compensated.

Figure 5:
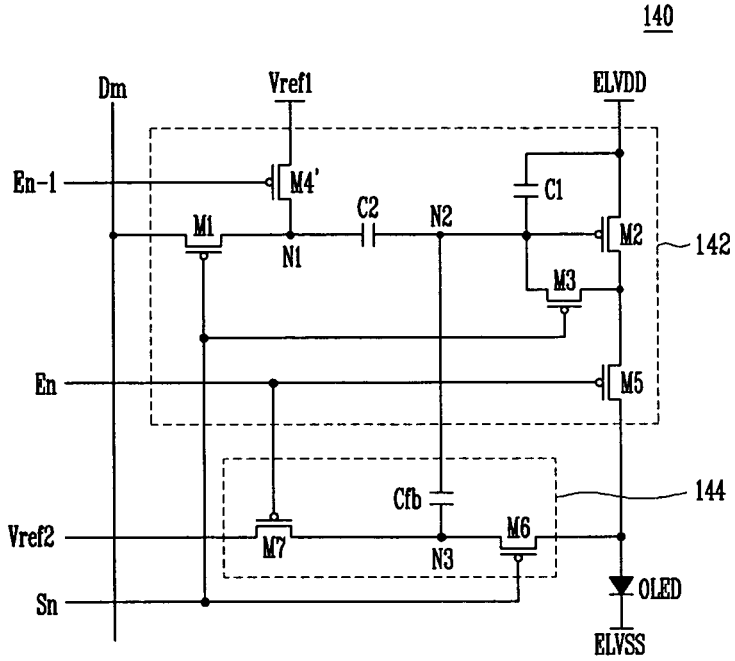
FIG. 5 illustrates an organic light emitting display according to another example embodiment.

FIG. 5 illustrates an organic light emitting display according to another example embodiment. The organic light emitting display in FIG. 5 is substantially the same as the organic light emitting display of FIGS. 2-4, with the exception of including a pixel with a fourth transistor M4' having a gate electrode coupled to an n-1 light emitting control line En-1.

Explaining an operation process, first the supply of a light emitting control signal to the n-1 light emitting control line En-1 may be suspended so that the fourth transistor M4' is turned on. If the fourth transistor M4' is turned on, voltage of a first node N1 is changed into voltage of the first reference power supply Vref1.

Thereafter, the voltage of the first node N1 may be changed into voltage of a data signal DS by a scan signal supplied to the scan line Sn. At this time, the voltage of the first node N1 may be reduced from the first reference power Vref1 to the voltage of the data signal. The voltage of the second node N2 may also vary in accordance with the voltage variation of the first node N1. In other words, the pixel of FIG. 5 may be driven in the same manner as the pixel of FIG. 4, with the exception of supplying the data signal DS to the first node N1 after the voltage of the first reference power supply Vref1 is supplied to the first node N1.

The pixel and an organic light emitting display according to example embodiments may be configured so increased deterioration of the OLED causes reduced supply of voltage to a gate electrode of a driving transistor. Accordingly, increased current may be supplied to the OLED from the driving transistor to compensate for deterioration thereof.

Example embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A pixel, comprising:

an organic light emitting diode (OLED);

a first transistor having a first electrode coupled to a data line, a second electrode coupled to a first node, and a gate electrode coupled to a scan line;

a second transistor coupled to the OLED, the second transistor being a driving transistor configured to supply current to the OLED;

a third transistor coupled between a gate electrode and a second electrode of the driving transistor, a gate electrode of the third transistor being coupled to the scan line;

a fourth transistor coupled between a first reference power supply and the first node, a gate electrode of the fourth transistor being coupled to an i-th light emitting control line or to an (i−1)-th light emitting control line, i being a natural number;

a fifth transistor coupled between the driving transistor and the OLED, a gate electrode of the fifth transistor being coupled to the i-th light emitting control line;

a first capacitor coupled between the gate electrode of the driving transistor and a first power supply;

a second capacitor coupled between the gate electrode of the driving transistor and the first node; and a compensator electrically connected to the OLED and the driving transistor, the compensator being configured to control a voltage of the gate electrode of the driving transistor with respect to deterioration of the OLED, wherein the compensator includes:

a sixth transistor coupled to an anode electrode of the OLED, the sixth transistor being configured to receive a scan signal, supplied to the scan line, at a gate electrode of the sixth transistor and to be turned on by the scan signal supplied to the scan line;

a seventh transistor coupled between the sixth transistor and a second reference power supply, the seventh transistor being configured to receive an i-th light emitting control signal, supplied to the i-th light emitting control line, at a gate electrode of the seventh transistor and to be turned off by the light emitting control signal supplied to the i-th light emitting control line; and a feedback capacitor coupled between a common node of the sixth transistor and the seventh transistor and a gate electrode of the driving transistor, the compensator being configured such that during a first period of a frame, both the sixth transistor and the seventh transistor are turned on, during a second period of the frame, the sixth transistor is turned on and the seventh transistor is turned off, during a third period of the frame, both the sixth transistor and the seventh transistor are turned off, and during a fourth period of the frame, the sixth transistor is turned off and the seventh transistor is turned on.

2. The pixel as claimed in claim 1, wherein the fourth transistor and the fifth transistor are turned off when a light emitting signal is supplied to the light emitting control line.

3. The pixel as claimed in claim 1, wherein the first transistor and the third transistor are turned on when a scan signal is supplied to the scan line.

4. The pixel as claimed in claim 1, wherein the first reference power is set as a higher voltage than a data signal supplied to the data line.

5. The pixel as claimed in claim 1, wherein the second reference power is set as a higher voltage than a threshold voltage of the OLED.

6. The pixel as claimed in claim 1, wherein the second reference power is set as a lower voltage than a threshold voltage of the OLED.

7. The pixel as claimed in claim 1, wherein:

the second capacitor is interposed between the first transistor and a second node, the second node receiving a voltage of the compensator, the first node is interposed between the first transistor and the second capacitor and interposed between the first transistor and the second node, and the second capacitor has a second electrode coupled to the second node, and has a first electrode coupled to the second electrode of the first transistor.

8. The pixel as claimed in claim 1, wherein the first, second, third, fourth, and fifth transistors are PMOS transistors.

9. The pixel as claimed in claim 1, wherein the first, second, third, fourth, fifth, sixth, and seventh transistors are PMOS transistors.

10. An organic light emitting display, comprising:

a scan driver configured to sequentially supply scan signals to scan lines and sequentially supply light emitting control signals to light emitting control lines;

a data driver configured to supply data signals to data lines; and pixels positioned at intersection regions of the scan lines, light emitting control lines, and data lines, each pixel including:

an organic light emitting diode (OLED);

a first transistor of which a first electrode is coupled to a data line, a second electrode is coupled to a first node, and a gate electrode is coupled to a scan line;

a second transistor coupled to the OLED, the second transistor being a driving transistor configured to supply current to the OLED;

a third transistor coupled between a gate electrode and a second electrode of the driving transistor, a gate electrode of the third transistor being coupled to the scan line;

a fourth transistor coupled between a first reference power supply and the first node, a gate electrode of the fourth transistor being coupled to any one of an i-th light emitting control line and an (i−1)-th light emitting control line, i being a natural number;

a fifth transistor coupled between the driving transistor and the OLED, a gate electrode of the fifth transistor being coupled to the i-th light emitting control line;

a first capacitor coupled between the gate electrode of the driving transistor and a first power supply;

a second capacitor coupled between the gate electrode of the driving transistor and the first node; and a compensator electrically connected to the OLED and the driving transistor, the compensator being configured to control a voltage of the gate electrode of the driving transistor with respect to deterioration of the OLED, wherein the compensator includes:

a sixth transistor coupled to an anode electrode of the OLED, the sixth transistor being configured to receive a scan signal, supplied to the scan line, at a gate electrode of the sixth transistor and to be turned on by the scan signal supplied to the scan line;

a seventh transistor coupled between the sixth transistor and a second reference power supply, the seventh transistor being configured to receive an i-th light emitting control signal, supplied to the i-th light emitting control line, at a gate electrode of the seventh transistor and to be turned off by the light emitting control signal supplied to the i-th light emitting control line; and a feedback capacitor coupled between a common node of the sixth transistor and the seventh transistor and a gate electrode of the driving transistor, the compensator being configured such that during a first period of a frame, both the sixth transistor and the seventh transistor are turned on, during a second period of the frame, the sixth transistor is turned on and the seventh transistor is turned off, during a third period of the frame, both the sixth transistor and the seventh transistor are turned off, and during a fourth period of the frame, the sixth transistor is turned off and the seventh transistor is turned on.

11. The organic light emitting display as claimed in claim 10, wherein the scan driver is configured to supply the light emitting control signal to the i-th light emitting control line after the scan signal is supplied to the i-th scan line, and to suspend supply of the light emitting control signal after supply of the scan signal is suspended.

12. The organic light emitting display as claimed in claim 10, wherein the first reference power is set as a higher voltage than the data signal.

13. The organic light emitting display as claimed in claim 10, wherein the second reference power is set as a higher voltage than the threshold voltage of the OLED.

14. The organic light emitting display as claimed in claim 10, wherein the second reference power is set as a lower voltage than the threshold voltage of the OLED.

* * * * *